United States Patent [19]

Dean

[11] Patent Number: 4,541,616

[45] Date of Patent: Sep. 17, 1985

[54] THERMAL BURNING ROD

[76] Inventor: Jessie L. Dean, 6119 W. Bank Expressway, Marrero, La. 70072

[21] Appl. No.: 613,513

[22] Filed: May 23, 1984

[51] Int. Cl.[4] ..... B23K 7/00

[52] U.S. Cl. ..... 266/48

[58] Field of Search ..... 266/48

[56] References Cited

U.S. PATENT DOCUMENTS

| | | | |
|---|---|---|---|
| 4,069,407 | 1/1978 | Brower | 266/48 |
| 4,114,863 | 9/1978 | Campana | 266/48 |
| 4,182,947 | 1/1980 | Brower | 266/48 |
| 4,416,444 | 11/1983 | Brower | 266/48 |

*Primary Examiner*—Wayland Stallard
*Attorney, Agent, or Firm*—Keaty & Keaty

[57] ABSTRACT

An improved rod for a thermal cutting or burning torch, especially suited for underwater use, is shown to have a metallic outer tube sheath containing exothermic fuel elements within the interior of the tube, providing an open region for the passage of gas to the tip of the tube. The tube is electrically insulated along its outer length, save for an exposed open end adapted to be clamped in an electrically conductive gas-providing cutting torch handle. Within the improved rod, each of the fuel elements consists of a generally ferrous composition having one of two types of coatings. In a first embodiment, an element will be coated with a copper cladding to approximately two percent of the overall weight of the element. In the second embodiment, an element will be clad with either aluminum, or one of the aluminum class of metals, to approximately 4.6 percent by weight, the exact percentage being that percentage required for perfect thermite combustion. In use, the rod containing at least one such element is inserted within an electrically-conducting, gas-providing handle. Pure oxygen is provided, pressurized through the length of the rod, driving water out from the rod and providing a positive oxygen flow. A source of electricity is then provided to the rod and is conducted to the open tip of the rod. A closed electrical circuit is provided between the rod and the object to be cut. Upon striking an arc with the rod, a thermite burning reaction is initiated, which continues even when the supply of electricity is terminated. The rod will burn so long as oxygen is provided, providing a particularly hot cutting flame. With fuel elements of the first embodiment, the flame is found to be as effective or more effective than a thermite cutting rod. With fuel element of the second embodiment, the ability to exactly match the proper portions of aluminum or the aluminum class of metals and iron for a thermite reaction is found to produce a more effective and efficient uniform burning rod. In both embodiments, spurious internal burning, resulting from internal electrical ignition effects, is largely eliminated.

18 Claims, 6 Drawing Figures

THERMAL BURNING ROD

BACKGROUND OF THE INVENTION

General requirements for cutting metals, especially metals such as steel, certain ceramics, and concrete, under water, have led to the development of a series of exothermic burning rods primarily based upon various thermite reactions involving the combustion of oxides of iron in the presence of oxygen atmospheres. In general, these rods are known to comprise an essentially ferrous burning element, which may be augmented with aluminum or a chemically related metal of the group comprising aluminum, magnesium, titanium, which is combusted in the presence of an oxygen atmosphere to produce an intensely hot oxidizing flame. Excess oxygen provides a burning or oxidizing capability which aids in the process of burning through a material to be cut.

Such rods and torches utilizing such rods have come into widespread use in underwater cutting. Oxygen is provided through the rod under a pressure sufficient to displace the water in the vicinity of the cutting element; the rod, being of a metallic composition, is ignited by creating an electrical circuit involving the rod and the object to be cut, supplying a relatively high amperage current so that contacting the rod to the element to be cut creates a large spark with sufficient electrical heat to ignite the rod.

The most recent developments in this type of thermite or exothermic burning rod may be seen in U.S. Pat. No. 4,069,1107 to Brower, which describes an elongated metallic rod suitable for the conduction of electricity having an insulating outer coating and having a plurality of interior elements running its length. With one exception, the elements are primarily of an iron composition. The exception is that at least one element, constructed of metal from the metallic group comprising aluminum, magnesium, titanium, or their alloys is included so as to provide the aluminum, iron, and oxygen mixture required for the classic thermite reaction. The rods are gripped in a pressure tight collect chuck in a specially designed torch handle which provides a continuous flow of oxygen at a pressure generally around 140 pounds per square inch over the ambient pressure in which the rod is expected to work. The oxygen passes the length of the rod through passages which are created by the spaces between the interior rods within the outer rod-holding element. An electrical source is provided to the rod capable of providing several hundred amperes of current, usually in the vicinity of 150–400 amperes. The entire rod and handle are part of a circuit which is completed through the object to be cut. Contacting the rod tip in the handle to the object to be torched creates an intense spark of heat which ignites the rod. It is known that once the rod is ignited, so long as oxygen continues to be applied to the burning iron element, the thermite reaction will continue the burn without further addition of electrical energy.

Rods of this nature, however, have serious problems. First, the fact that the thermite mixture is comprised of a finite number of elements which are either iron or aluminum creates a definite limitation on the achievable ratios of aluminum to iron, and it is found that the Brower rod normally runs 16 to 20 percent aluminum as a minimum in order to meet the requirement of having an integral number of rods, while having sufficient interior free area for the flow of oxygen. It is found that such colocated individual elements will independently burn once ignited in the oxygen atmosphere that surrounds them. The overall reaction is both uneven and colder than a theoretical thermite reaction should be, and thus the rod will not cut all objects which could be cut by a pure thermite reaction.

In addition, since the rod is ignited by electrical arcing, interior electrical arcing within the rod will create points of burning inside the rod. This process creates a situation in which an interior burn within the rod will cause the rod to burn, jetting a hole through a side of the rod, bleeding off the oxygen pressure, and rendering the rod unusable or dangerous.

SUMMARY OF THE INVENTION

It is the particular discovery of this invention that the classic thermite or exothermic rod may be best built by providing an outer casing for enclosing the thermite rod, which remains insulated, and inserting within this casing a unique clad thermite burning element of a construction permitting passage of adequate oxygen for both supporting the thermite reaction and for providing an oxidizing flame at the end of the torch. The thermite element comprises at least one elongate ferrous exothermic fuel element which is clad with an aluminum cladding or with a copper cladding. Each individual exothermic element within the rod is uniformly coated for the length.

Inasmuch as each of the individual exothermic elements within the rod independently contain an aluminum or copper coating of the exact proportions necessary for perfect thermite burning, and in addition, due to the fact that this coating also provides a low conductivity path along each of the rods individually, the inventive rod of this construction overcomes both of the prior major problems of the art.

First, inasmuch as each of the individual thermite elements is independently coated with a highly conductive material, there is essentially no internal arcing within the rod. Thus, the incidence of blowouts or side burnouts is essentially eliminated.

Secondly, for ferrous elements coated with an aluminum, magnesium, titanium or related alloy coat, the current state of the the art's ability to control the cladding permits production of a nearly theoretical perfect thermite mixture ratio of aluminum to iron, so that the rod burns with maximal heat. It has been determined that the thermal rod of the inventive construction is capable of cutting materials that older art thermal burning rods can not cut.

Separately, it has been discovered that if the thermite element are coated with a thin coating of copper and are burned in an oxygen atmosphere, that the combined rod burns at a hotter level than the classic thermite rod, and provides a particularly advantageous cutting rod.

It is further noted that a fuel element may be coated with both aluminum and copper with particularly beneficial effects.

It is thus an object of this invention to provide a method of construction of an exothermic or thermite burning rod which is capable of achieving more exact thermite compositions for a hotter burning flame.

It is a further object of this invention to provide an exothermic burning rod which produces a hotter burning flame than heretofore has been possible.

It is a further object of this invention to provide an exothermic burning rod of the class ignited by electrical currents wherein the problem of internal ignition within the rod and blowout through the side of the rod is essentially eliminated.

It is a further object of this invention to provide an exothermic burning rod which is capable of being electrically ignited at smaller current levels than heretofore have been possible.

DETAILED DESCRIPTION OF THE PREFERRED EMBODIMENT

Figure 5:
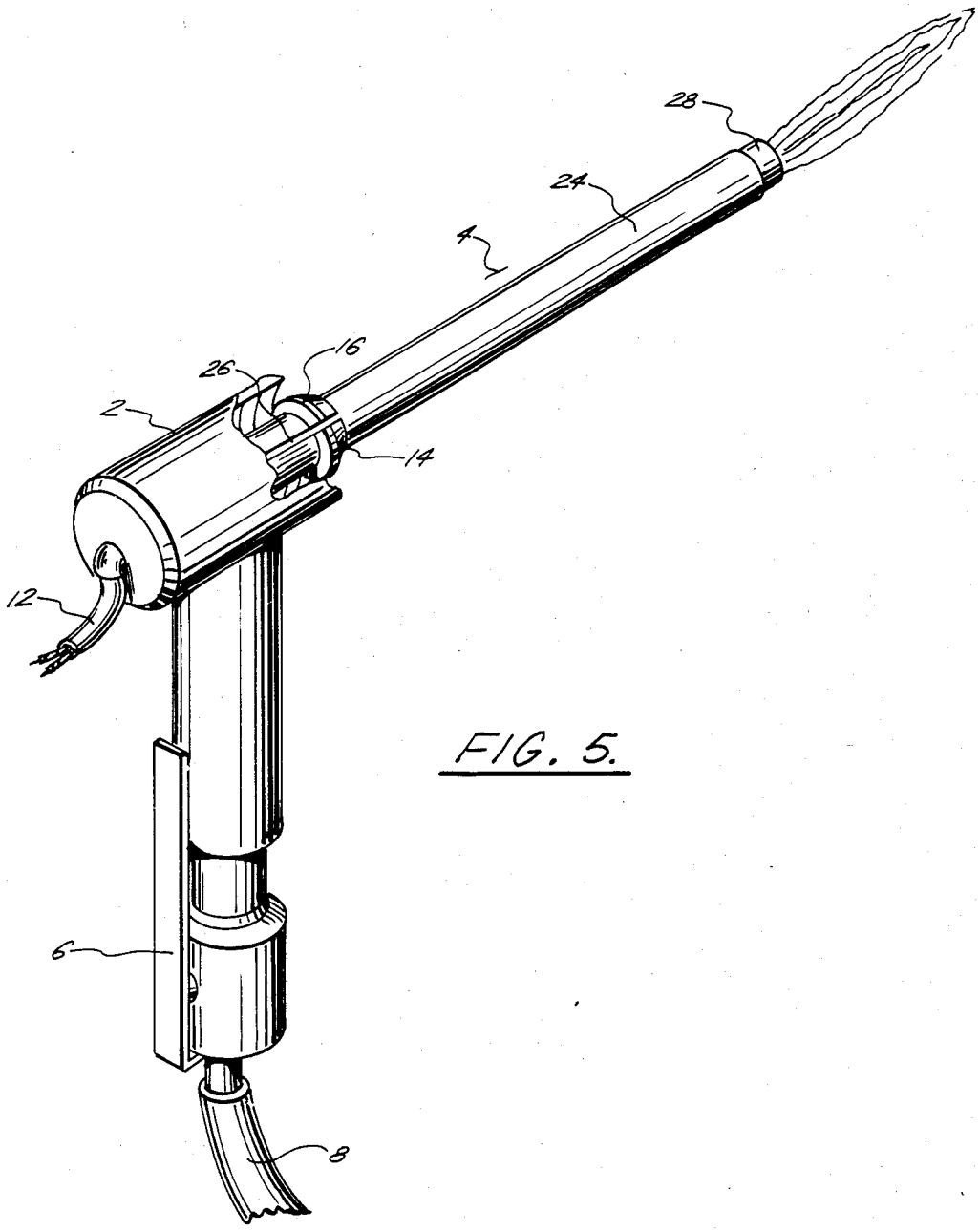
FIG. 5 is a perspective view of a torch and handle with a partially cutaway section to show means for gripping the fuel rod.

Referring to the drawings and specifically to FIG. 5, an exothermic torch assembly (2) is shown adapted to supporting the inventive exothermic burning rods (4) of the current invention. The exothermic burning torch (2) is designed to support an elongate burning rod (4) having an essentially ferrous internal burning element, supplying this element with a continuous flow of oxygen so as to create the classic iron oxide and oxygen burning combination which is known to produce an extremely hot, oxidizing burning flame. This is the basic reaction known to occur in the thermite class of incendiary objects and produces an extremely hot, oxidizing, directed flame.

The torch assembly (2) thus comprises, as is known in the art, general gas control means (6) for controlling the flow of oxygen through the rod (4). Oxygen is provided through gas supply means (8) in a continuous pressurized supply at the gas flow control means (6). As is known, the overall combination of the gas supply means (8) and the gas flow control means (6) is designed so as to provide an oxidizing gas, preferably oxygen, in a positive pressure over ambient, usually on the order of 140 pounds per square inch over ambient. This differential oxygen pressure permits the overall torch assembly (2) to be used in underwater environments, as the individual oxygen pressure expels water from the rod (4) and creates a bubbling gas barrier around an outer end of the rod (4) so as to permit ignition and burning of the rod (4) as will be hereinafter described.

Figure 6:
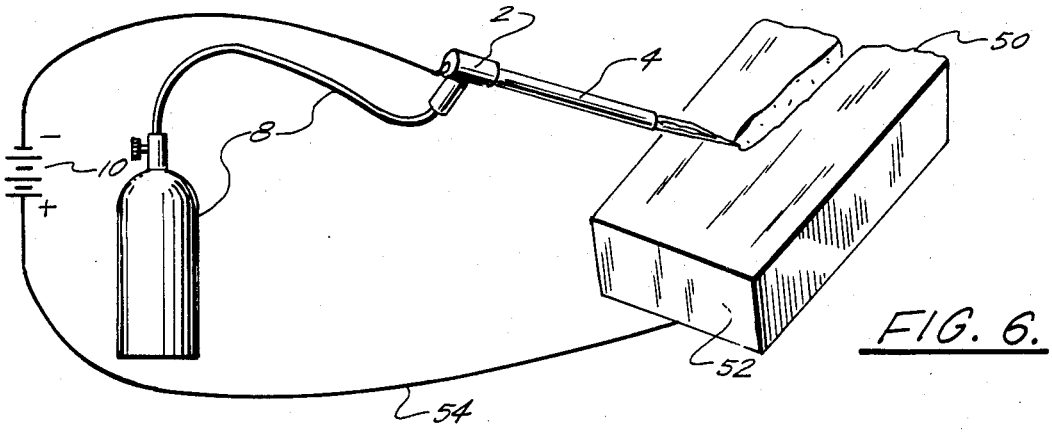
FIG. 6 is a schematic view showing implementation of the present invention.

It is customary, due to the nature of underwater work, to provide an ignition means for the overall rods (4) as follows. As schematically shown in FIG. 6, an electrical power source (10) usually a 12 volt battery of at least 100 amperes hour rating is provided connected through an inlet cable (12) to the torch assembly (2). Internally to the torch assembly (2) electrode clamp means (14), usually comprising a form of gripping collet (16), are electrically connected to the inlet cable (12). This permits a source of electricity to be provided through the rod (4). A material to be burned (50) is provided with a conductive initiating area (52), connected by an electrical lead (54) to the electrical power source (10). Touching the tip of the rod (4) to the initiator point (52) completes an electrical circuit through the electrical power source (10). The electrical power source (10) is a high amperage low voltage source; in the prior art 300 to 600 amperes current flow is required. This completion by touching of the rod (4) to the initiating area (52) creates an intense arc which in turn serves to ignite the rod (4).

Figure 1:
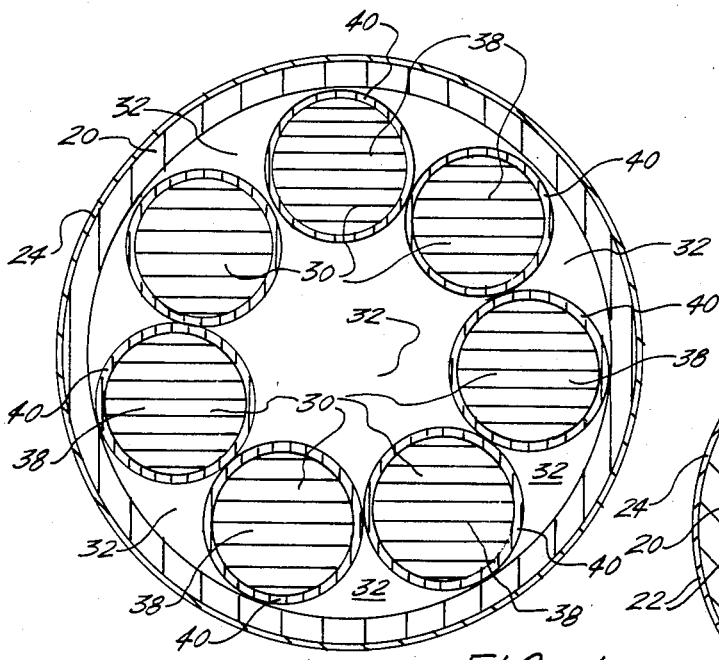
FIG. 1 is an enlarged sectional end view of the electrode in accordance with the first embodiment of the present invention.
Figure 2:
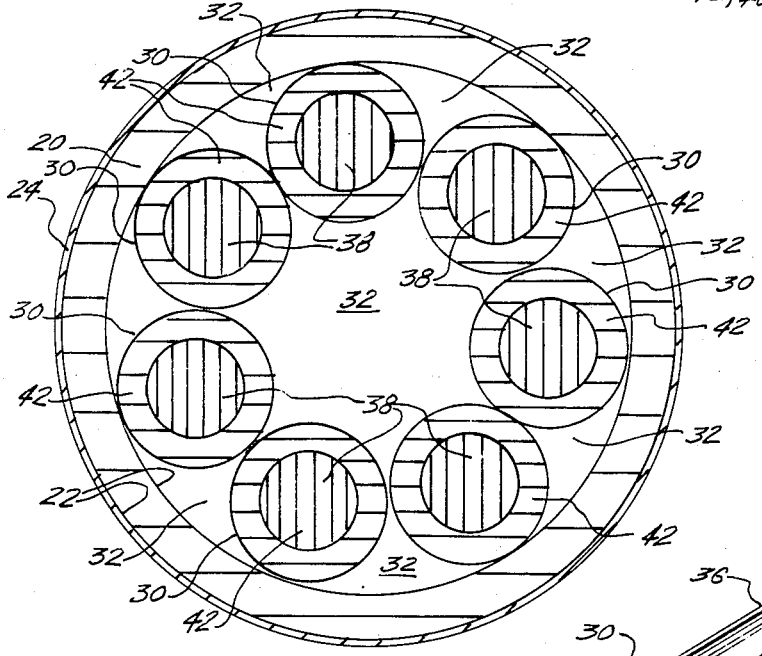
FIG. 2 is an enlarged sectional view of the electrode in accordance with a second embodiment of the present invention.
Figure 4:
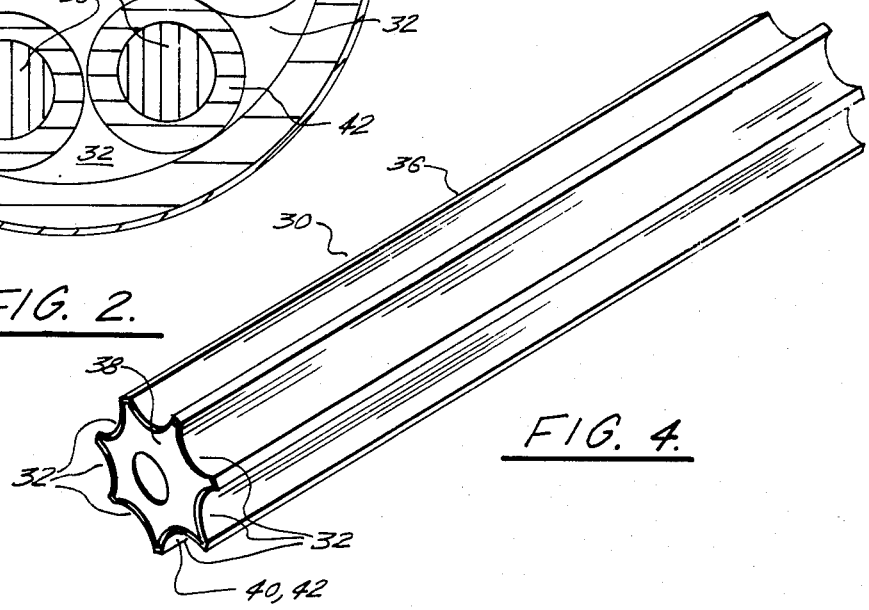
FIG. 4 is a perspective view of the exothermic fuel rod in accordance with a third embodiment of the present invention.

As shown in FIGS. 1 and 2, the inventive rods (4) of this invention comprise an outer elongate rod case (20), preferably in the form of a generally metallic tube. The rod case (20) is most typically made of a ferrous tube in order to withstand the pressure effects of the differential pressure oxygen supply described above. Additionally, it has long been known that it is beneficial to clad the rod case (20) with a corrosion resistant cladding (22). Most typically, this cladding has been copper; the use of such a copper cladding (22) is old in the art. As described above, the burning rods (4) are typically ignited by electrical means and therefore it is found that an insulation coating (24) is provided along the exposed outer surface of the rod case (20) so as to prevent accidental contact to an electrically charged rod (4) and so as to prevent electrical shock hazards.

The insulation coating (24) is removed from a first end of the rod case (20) so as to provide a conductive grip end (26) on the rod (4). The conductive grip end (26) is adapted to be conductively gripped by electrode clamp means (14) of the torch assembly (2) and is a portion of the electrical circuit providing electrical power to the overall rod (4) for ignition purposes. The insulation coating (24) is also removed from a small portion of the other end of the rod (4) forming a conductive strike tip (28) permitting ignition by contact with the initiating area (52) as described above.

The burning effect of the rod (4) is provided by exothermic fuel means (30) which are axially disposed the length of the interior of the rod case (20). Exothermic fuel means (30) are shaped or placed within rod case (20) so as to provide a substantially uniform series of gas passages (32) extending lengthwise within the rod case (20). The gas passages (32) are designed to permit flow of an oxidizing gas from the gas flow control means (6) of the torch assembly (2) through the length of the rod (4), emiting from the conductive strike tip (28) of the rod (4). It is important for the uniform burning of the exothermic fuel means (30) that the gas passages (32) provide an essentially surrounding blanket of the supplied oxidizing gas, most typically oxygen, to the point of burning of the exothermic fuel means (30).

In a first embodiment of the invention, exothermic fuel means (30) comprise a plurality of wires or rod elements (34) inserted circumferentially and axially within rod case (20) as shown in FIG. 1. The packing effect of the essentially cylindrical wires (34) serves to clamp the wires (34) tightly within rod case (20), while equally serving to define gas passages (32), both through the center axis of the rod (4) and periodically along an outer annular region between the exothermic fuel means (30) and the rod case (20) along rod (4).

Figure 3:
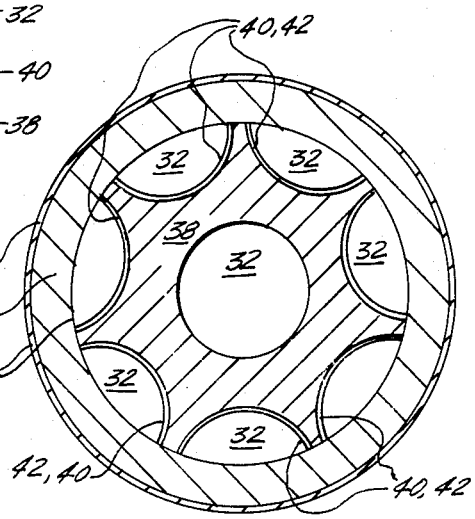
FIG. 3 is a enlarged sectional view of the electrode in accordance with a third embodiment of the present invention.

FIG. 3 shows an alternate embodiment of the exothermic fuel means, in the form of a shaped extrusion (36). Again, shaped extrusion (36) is shaped and sized so as to provide a tightly contacting insertion the length of rod case (20). Again, shaped extrusion (36) is shaped so as to provide gas passages (32) both axially through the center of the rod (4) and periodically along an outer annular region between the exothermic fuel means (30) and the rod case (20).

Each of the exothermic fuel means (30) in the invention further comprises a ferrous inner core (38) and a particular outer cladding. In a first embodiment of the invention, the outer cladding is a copper coating (40), cladding (40), most typically electroplated, along the ferrous inner core (38).

In a second embodiment of the invention, the cladding is a heavier cladding comprising one of the group of aluminum, magnesium, titanium or their alloys. These are the classic thermite metals; in the standard preferred embodiment of the invention aluminum is used. Throughout this detailed description, the metal will be described as aluminum, inasmuch as the art of cladding aluminum to a ferrous inner core is now well-developed and provides significantly fewer production problems, lower cost, and higher yield than the cladding of magnesium or titanium to a ferrous inner core. Nevertheless, it should be understood that the thermite reaction described involves metals of this aluminum group and it should be understood throughout the discussion that where aluminum is discussed the other metals are equally applicable.

A third embodiment clads the ferrous inner core (38) with both copper and an aluminum group metal.

In operation, there are two separate effects which determine the proportions of cladding to ferrous inner core in each of the embodiments. It is important to recognize that the typical use of the inventive rod (4) is in an underwater, electrically initiated exothermic burning rod torch. Under these circumstances, it is important to recognize that a significant electric current pulse will be transmitted along the rod (4) during the ignition cycle of the rod. The former arc burning rods utilize essentially iron inner elements, which have fairly high resistivities, disposed within a copper clad outer core which has a fairly low surface resistivity. This has resulted in electrical sparking and internal ignition within the rod as well as at the tip.

In addition, one of the aluminum class metals was provided as an additional fuel element so as to provide the presence of aluminum to produce the thermite burning reaction for the hottest possible burning flame. In the prior art rods, this element was provided as a single aluminum wire interposed with a plurality of ferrous wires. Realistic manufacturing constraints resulted in an excess of aluminum, typically 16% by weight, being provided, well over that desirable for thermite reactions; in addition, the placing of the aluminum as a single unitized aluminum wire colocated with a plurality of ferrous wires produced limited mixing of the aluminum and the ferrous components at the flame front due to the effects of the pressure of the gas and the direction of the flame, thus providing a very uneven burn.

For this reason, the copper cladding (40) or the aluminum-class metal coating (42) provide two separate effects within the inventive rod (4). First, it is a significant part of this invention that a copper cladding (40) over a ferrous inner core (38) provides an augmented burning reaction involving aluminum and iron. The copper cladding sufficient to provide this augmented burning effect is not fully understood by applicant, but is believed to involve significantly small amounts of copper; a measurable amount of copper is required, but clearly less than two percent copper by weight to the ferrous inner core is sufficient. It is significant that the copper be clad directly on the ferrous inner cores (38) of the exothermic fuel means (30). In this regard it is important to note that the long term prior art copper cladding (22) on the rod case (20) does not produce the augmented burning effect within a rod containing a copper clad rod case (20) and a pure ferrous exothermic fuel means (30) disposed therein. The augmented effect is only found when the individual exothermic fuel means (30) are copper clad.

It is also part of this invention that the individual uniform cladding of the ferrous inner core (38) of the exothermic fuel means (30) by a uniform coating of the aluminum metals (42) provides a uniform thermite burning effect superior to the prior art combination of separate aluminum and ferrous exothermic rod elements within an overall burning rod. Thus, it has been discovered that in the second embodiment of the current invention, a rod (4) having an aluminum clad exothermic fuel means (30), that the resulting rod (4) burns with a uniformly hotter burning flame than the prior art rods and that the material to be burned (50) includes difficult to burn materials such as barnacles, lime-embedded cement, and, certain burn-resistant ceramics. It aids this uniform burning that the overall coating thickness of the aluminum cladding (42) upon the ferrous inner core (38) can be controlled in the manufacturing process so as to produce a linear, uniformly thick coating, providing the desired 4.6 percent aluminum-to-ferrous weight ratio which is chemically considered the preferred ratio of aluminum to ferrous for the best thermite burning reaction. Further, it is advantageous to have a uniform supply of the preferred ratio of metals during the burning process; the clad fuel elements of the invention provide this constant, uniform ratio. The amount of clad metal which creates the best burning reaction in a chemical combination of clad metal, the ferrous inner core, and the feed oxygen, has been defined by applicant as being an exothermically sufficient quantity of cladding.

Applicant has determined that the exothermically sufficiently cladding of aluminum is close to 4.6 percent aluminum by weight of iron. Chemically similar ratios of magnesium and titanium are believed to be preferred. For copper, the exothermically sufficient amount of copper has been determined to be greater than a brace amount but less than 2 percent by weight copper. The exothermic effect has been observed with relatively thin electroplated coatings of copper on ferrous inner cores (38).

Inasmuch as the preferred usage of the rods (4) is for an electrically ignited rod in underwater usage, the effects of the pulse of electrical current provided through the electrical power source (10) must be considered. As has been described above, it is a typical failure mode of the prior art rods that they ignite internally as well as at the conductive strike tip (28). When this occurs, the rods fail rapidly by burning through the rod case (20) at points along the length of the rod (4), diverting the gas flow through the gas passages (32), rendering the rod inoperative.

It is a part of this invention that in an electrically ignited exothermic burning rod, the copper cladding (40) or the aluminum metal cladding (42) over the ferrous inner core (38) may be made of a thickness to support essentially the entire flow of the current provided for ignition from the electrical power source (10). It is then a significant part of this invention that by making the cladding (40) or cladding (42) of a "conductively sufficient" thickness so as to conduct substantially all of the electrical power flow within the cladding rather than the ferrous core, that the incidence of internal ignition and burnout within the rods (4) is substantially eliminated.

It is found that the 4.6 percent by weight aluminum cladding which is above defined as exothermically sufficient is also, for aluminum, conductively sufficient. The preferred copper cladding (40) in a conductively sufficient quantity is 2 to 4 percent by weight, and in this case is a greater thickness than would be required for an exothermically sufficiently cladding.

Thus, the desired thickness or metallic weight of the copper cladding (40) depends upon whether the rod (4) is intended to be electrically ignited or not, due to the fact that it appears that the desired cladding thickness will vary depending upon whether it is desired to have an optimum exothermic burning rod or, alternatively, desire to have a blowout resistant, electrically ignited, exothermic burning rod.

It is a part of this invention that the specific inclusion of the particular exothermic fuel means (30) of the inventive rod (4) can serve either purpose independently and thus the invention as claimed encompasses both those variants which are designed for best burning effect and alternately are designed for most failure free electrically ignited effect.

It is further noted, as the conductively sufficient cladding essentially prevents internal rod arcing and failure, the current invention permits continued electrical power to be supplied to the rod during burning. This increases the burn efficiency of the inventive rod by approximately 17% over the unpowered, thermite burn.

As an alternative construction, it has been determined that the inventive fuel elements may be clad with both a trace amount of copper and a conductively sufficient amount of aluminum. The resulting fuel element appears superior in performance to an aluminum only clad element.

Thus it should be seen that the desired inventive rod (4) encompasses not just the specific embodiments described above, but rather that wider range of equivalents for the desired purpose as are set forth in the claims.

I claim:

1. An exothermic burning rod, adapted for use in a gas-fed burning torch, comprising:
   an elongate external tube means;
   exothermic fuel means extending axially within said tube means, further comprising:
   an essentially ferrous inner core;
   a copper outer coating; and
   gas passing means internally extending within said tube adjacent said exothermic fuel means.

2. An apparatus as described in claim 1 above wherein said copper coating is in conductively sufficient proportion to said ferrous core.

3. An apparatus as described in claim 1 above wherein said copper coating is in exothermic sufficient proportion to said ferrous inner core.

4. An exothermic burning rod, adapted for use in a gas-fed burning torch, comprising:
   an elongate external tube means;
   exothermic fuel means extending axially within said tube means, further comprising:
   an essentially ferrous inner core;
   an outer coating of a metal selected from the group consisting of: aluminum, magnesium, titanium and alloys of aluminum, magnesium or titanium; and
   gas passage means internally extending within said tube adjacent said said exothermic fuel means.

5. An apparatus as described in claim 4 above wherein said coating is in conductively sufficient proportion to said ferrous core.

6. An apparatus as described in claim 4 above wherein said coating is in exothermic sufficient proportion to said ferrous core.

7. The apparatus of claim 1 above wherein said exothermic fuel means further comprises a plurality of said ferrous wires having said coating axially, clampingly engaged within said tube.

8. The apparatus of claim 4 above wherein said exothermic fuel means further comprises a plurality of ferrous wire having said coating axially, clampingly engaged within said tube.

9. The apparatus of claim 1 above wherein said exothermic fuel means further comprises a unitized, ferrous extrusion having said coating contactingly, axially disposed within said tube.

10. The apparatus of claim 4 above wherein said exothermic fuel means further comprises an elongate ferrous extrusion having said coating contactingly, axially extending within said tube.

11. In an exothermic burning rod having an outer rod casing, at least one internal ferrous fuel element, and gas passage means adapted for supplying a continuous flow of pressurized oxygen to a point of combustion of said ferrous fuel element, the improvement comprising:
   a uniform cuprous cladding on said fuel element.

12. The apparatus as described in claim 11, wherein said cladding is provided in a conductively sufficient proportion to said ferrous element.

13. In an exothermic burning rod having an outer rod casing, at least one internal ferrous fuel element and gas passage means adapted for supplying a continuous flow of pressurized oxygen to a point of combustion of said ferrous fuel element, the improvement comprising:
   a uniform cladding of a metal chosen from the group consisting of aluminum, magnesium, titanium and alloys of aluminum, magnesium or titanium on said fuel element.

14. The apparatus as described in claim 11, wherein said cladding is provided in a conductively sufficient proportion to said ferrous element.

15. An exothermic burning rod, adapted for use in a gas-fed torch, comprising:
   an elongate conductive outer tube member;
   exothermic fuel means extending axially within said tube means, further comprising:
   an essentially ferrous inner core;
   a copper outer coating; and
   gas passage means internally extending within said tube adjacent said exothermic means.

16. An apparatus as described in claim 15 above wherein said coating is in conductively sufficient proportion to said ferrous core.

17. An exothermic burning rod, adapted for use in a gas-fed burning torch, comprising:
   an elongate conductive outer tube member;
   exothermic fuel means extending axially within said tube means, further comprising:
   an essentially ferrous inner core;

an outer coating of a metal selected from the group consisting of aluminum, magnesium, titanium and alloys of aluminum, magnesium or titanium, and gas passage means extending internally within said tube adjacent said exothermic fuel means.

18. An apparatus as described in claim 17 above wherein said coating is in exothermic sufficient proportion to said ferrous inner core.

* * * * *